US012180639B2

(12) United States Patent
Huang et al.

(10) Patent No.: US 12,180,639 B2
(45) Date of Patent: Dec. 31, 2024

(54) ADDITIVE FEEDING DEVICE AND WASHING MACHINE

(71) Applicants: QINGDAO HAIER WASHING MACHINE CO., LTD., Shandong (CN); HAIER SMART HOME CO., LTD., Shandong (CN)

(72) Inventors: Tao Huang, Shandong (CN); Bingheng Zhou, Shandong (CN); Haifeng Ren, Shandong (CN)

(73) Assignees: QINGDAO HAIER WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 429 days.

(21) Appl. No.: 17/632,461

(22) PCT Filed: Jul. 31, 2020

(86) PCT No.: PCT/CN2020/106232
§ 371 (c)(1),
(2) Date: Feb. 2, 2022

(87) PCT Pub. No.: WO2021/023112
PCT Pub. Date: Feb. 11, 2021

(65) Prior Publication Data

US 2022/0275561 A1 Sep. 1, 2022

(30) Foreign Application Priority Data

Aug. 2, 2019 (CN) ..... 201910713121.3
Aug. 2, 2019 (CN) ..... 201910713127.0

(51) Int. Cl.
*D06F 39/02* (2006.01)
*D06F 39/08* (2006.01)

(52) U.S. Cl.
CPC ..... *D06F 39/022* (2013.01); *D06F 39/088* (2013.01)

(58) Field of Classification Search
None
See application file for complete search history.

(56) References Cited

FOREIGN PATENT DOCUMENTS

CN 103343436 A 10/2013
CN 107287839 A 10/2017
(Continued)

OTHER PUBLICATIONS

KR 101233243 B1 translation Washing Machine (Year: 2013).*
(Continued)

*Primary Examiner* — Cristi J Tate-Sims
(74) *Attorney, Agent, or Firm* — Panitch Schwarze Belisario & Nadel LLP

(57) ABSTRACT

An additive feeding device includes a water supply pipeline, the water supply pipeline is provided with a rising convex part for increasing the height of a water path in the fed water stream direction, and the water supply pipeline on the upstream of the rising convex part is connected with a liquid storage box through a suction structure, and the additive pumped into the water supply pipeline flows to the upstream of the water supply pipeline in a countercurrent mode under the blocking action of the rising convex part. By means of the arrangement, the automatic feeding device can suck the additive into the water supply pipeline through the suction structure, the pumped additive flows to the upstream of the water supply pipeline in a countercurrent mode under the blocking action of the rising convex part arranged in the water supply pipeline.

18 Claims, 7 Drawing Sheets

(56) References Cited

FOREIGN PATENT DOCUMENTS

| | | | |
|---|---|---|---|
| CN | 108930141 | A | 12/2018 |
| CN | 109898292 | A | 6/2019 |
| CN | 211571119 | U | 9/2020 |
| CN | 211596110 | U | 9/2020 |
| CN | 112239938 | A | 1/2021 |
| EP | 3358065 | A1 | 8/2018 |
| GB | 2353540 | A | 2/2001 |
| JP | 2019037357 | A | 3/2019 |

OTHER PUBLICATIONS

International Search Report (PCT/ISA/210) and Written Opinion (PCT/ISA/237) with translations mailed on Oct. 29, 2020, by the China Patent Office as the International Searching Authority for International Application No. PCT/CN2020/106232.

Extended European Search Report issued on Feb. 14, 2023, by the European Patent Office in corresponding EP Application No. 22206992.4.

Office Action issued on Mar. 25, 2022, by the State Intellectual Property Office of People's Republic of China in corresponding CN Application No. 201910713121.3, and English translation of the Office Action.

* cited by examiner

ADDITIVE FEEDING DEVICE AND WASHING MACHINE

TECHNICAL FIELD

The disclosure relates to a washing machine in the field of household appliances, in particular to an automatic feeding device applied to the washing machine and used for adding an additive in the clothes treatment process.

BACKGROUND

Additives such as a washing agent, a softening agent and a disinfectant used in the washing process of a traditional washing machine are separated from the washing machine, an additive feeding device is not arranged on the washing machine, the additives cannot be automatically fed, and the structure cannot achieve the full-automatic washing control process of the washing machine. Along with the improvement of automation of the washing machines, most of the washing machines are arranged in a manner that an additive box for containing a detergent or/and a softening agent communicates with a water inlet pipeline, the detergent or/and the softening agent in the additive box is flushed into a water containing drum through fed water, but according to the structure, the detergent or/and the softening agent needs to be put into the additive box firstly every time washing is carried out; and a full-automatic washing control process is not realized as well.

A large number of patents related to automatic additive feeding devices exist at present, for example, a washing machine detergent adding device disclosed in the previous Chinese patent is characterized in that a containing cavity matched with a bottle is formed in a washing machine box body, a conical through hole is formed in the bottom of the containing cavity, and a vertical fixing piece is fixed to the through hole; the vertical fixing piece fixes a washing liquid guide pipe, the bottle body is matched with the containing cavity, a conical guide-in pipe is arranged on a bottle opening, and a ventilation opening is formed in the bottom of the bottle body. The structure cannot control the adding amount of the detergent and is easy to damage to waste the detergent.

Another Chinese patent application document discloses a detergent supply device of a washing machine with a detergent box having a siphon unit, the detergent is injected into the detergent box, washing water is injected into the detergent box to dilute the detergent in the box, and then the diluted detergent is discharged into a washing cylinder from the siphon unit. The problem that washed clothes are damaged due to the fact that a concentrated detergent directly enters a washing cylinder is solved, but automatic additive accurate control of the detergent cannot be achieved.

However, after an existing automatic additive feeding device is used, blockage is caused by the fact that the additive remains in an internal pipeline of the device, and next use of the additive feeding device is affected. Meanwhile, an existing additive automatic feeding device generally has the problems of a complex structure, excessive control structures and the like, so that the cost of the automatic feeding device is too high, and popularization cannot be realized.

In addition, in order to ensure that the pumped additive does not flow out of the water outlet of the water path along with the water stream to achieve the effect of temporary storage in the water path, the water path needs to be reasonably improved.

In view of this, the disclosure is proposed.

SUMMARY

The disclosure aims to provide an automatic additive feeding device so as to achieve the purpose of automatically feeding the additives. Another purpose of the disclosure is to provide an automatic additive feeding device so as to achieve the purpose of blocking and preserving the additive pumped out by a suction mechanism, and another purpose of the disclosure is to provide a washing machine to achieve the purposes of providing various forms of fed water streams for the water containing drum and correspondingly feeding different types of additives.

In order to achieve the purposes, the specific technical solution adopted by the disclosure is as follows:

An additive feeding device includes a water supply pipeline, the water supply pipeline is provided with a rising convex part for increasing the height of a water path in the fed water stream direction, and the water supply pipeline on the upstream of the rising convex part is connected with a liquid storage box through a suction structure and the additive pumped into the water supply pipeline flows to the upstream of the water supply pipeline in a countercurrent mode under the blocking action of the rising convex part.

Furthermore, a liquid storage cavity is connected to the water supply pipeline in series, the liquid storage cavity is located on the water supply pipeline on the upstream of the position where the liquid storage cavity is connected with the suction structure, and the additive flowing in a countercurrent mode enters the liquid storage cavity to be temporarily stored under the effect of the rising convex part.

Furthermore, the liquid pumping structure is connected with the middle part of the second water supply pipe section, each of the upstream and the downstream of the connecting position is provided with at least one rising convex part, a first rising convex part on the upstream of the connecting position causes the upstream pipeline to be lower than the connecting position, and a second rising convex part on the downstream of the connecting position causes the downstream pipeline to be higher than the connecting position.

Furthermore, the liquid storage cavity is located on the water supply pipeline on the upstream of the second rising convex part.

Furthermore, the water supply pipeline includes a first water supply pipe section and a second water supply pipe section; the liquid storage cavity is connected with a water inlet of the additive feeding device through the first water supply pipe section, and the liquid storage cavity is connected with an opposite-flushing mechanism of the additive feeding device through the second water supply pipe section.

Furthermore, the suction structure includes a connecting pipeline connected with the water supply pipeline in parallel, one end of the connecting pipeline is connected with the water inlet of the feeding device and a water inlet end of the first water supply pipe section through a tee joint, and the other end is connected with a pump inlet of a pump, and a pump outlet of the pump is connected with the middle part of the second water supply pipe section of the water supply pipeline; the middle part of the connecting pipeline is connected with the liquid storage box through a liquid pumping pipeline.

Furthermore, a first one-way check valve is arranged on the connecting pipeline or the connecting position of the first water supply pipe section and the water inlet of the feeding device so as to control the liquid in the pipeline to only flow from the tee joint to the connecting pipeline or the first water supply pipe section; a second one-way check valve is arranged on the liquid pumping pipeline, or the connecting position of the liquid pumping pipeline and the connecting pipeline, or the connecting position of the liquid pumping pipeline and the liquid storage box so as to control the liquid in the pipeline to only flow from the liquid storage box to the connecting pipeline.

Furthermore, a boss protruding and rising towards the interior of the second water supply pipe section is arranged at the connecting position of the pump outlet and the second water supply pipe section, and a water inlet end of a first water inlet branch of the opposite-flushing mechanism is higher than the boss; the height difference between the boss and the second water supply pipe section is utilized to form a first rising convex part on the upstream of the connecting position of the pump outlet and the second water supply pipe section, and the height difference between the boss and a water inlet end of a second water inlet branch forms a second rising convex part on the downstream of the connecting position of the pump outlet and the second water supply pipe section.

Furthermore, the second water supply pipe section is arranged to obliquely extend from the storage cavity to the gradually rising direction of the opposite-flushing mechanism.

Furthermore, the second water supply pipe section is provided with two straight line extending parts extending parts extending in parallel, ends on the same sides of the two straight line extending parts are connected through a bent part, and ends on the other sides of the two straight line extending parts are connected with a first opening of the liquid storage cavity and the first water inlet branch of the opposite-flushing mechanism respectively.

Furthermore, the water path on the water box further includes a second water supply pipeline, one end of the second water supply pipeline is connected with a second water inlet of the feeding device, the other end of the second water supply pipeline is connected with the opposite-flushing mechanism, control valves for controlling corresponding water feeding on-off are installed at the water inlet and the second water inlet of the feeding device respectively, or the water inlet and the second water inlet are arranged on a same reversing valve, and water is fed into the water inlet and the second water inlet respectively or simultaneously.

Furthermore, the opposite-flushing mechanism includes a first water inlet branch and a second water inlet branch, and a first water outlet branch, a second water outlet branch and a third water outlet branch, wherein water outlet ends of the first water inlet branch and the second water inlet branch are staggered by an inclined angle and are arranged on the same side of the opposite-flushing mechanism, water inlet ends of the first water outlet branch, the second water outlet branch and the third water outlet branch are arranged on the other opposite side of the opposite-flushing mechanism; the second water supply pipe section of the water supply pipeline communicates with the water inlet end of the first water inlet branch, the water outlet end of the first water inlet branch is coaxially and oppositely spaced from the water inlet end of the first water outlet branch, and when the water supply pipeline supplies water independently, a supplied water stream is sprayed out from the water outlet end of the first water inlet branch and flows into the water inlet end of the first water outlet branch; the second water supply pipeline communicates with the water inlet end of the second water inlet branch, the water outlet end of the second water inlet branch is coaxially and oppositely spaced from the water inlet end of the second water outlet branch, and when the second water supply pipeline supplies water independently, the supplied water stream is sprayed out from the water outlet end of the second water inlet branch and flows into the water inlet end of the second water outlet branch; the water inlet end of the third water outlet branch is located between the water inlet end of the first water outlet branch and the water inlet end of the second water outlet branch, and when the water supply pipeline and the second water supply pipeline supply water at the same time, two water streams interfere with each other and are combined into the same supplied water stream which flows into the water inlet end of the third water outlet branch.

The disclosure further provides a washing machine, the additive feeding device according to any one of the above claims is installed on the washing machine, and the water supply pipeline of the additive feeding device is connected with a water containing drum of the washing machine so that the additive pumped out of the liquid storage box by the suction structure can be conveyed into the water containing drum.

Furthermore, the water outlet end of the first water outlet branch of the automatic feeding device communicates with a main washing water inlet pipe arranged on the washing machine through a main washing cavity, the water outlet end of the second water outlet branch communicates with a spraying device through a spraying opening, and the water outlet end of the third water outlet branch communicates with a softener feeding pipe arranged on the washing machine through a softener cavity; the main washing water inlet pipe, the spraying device and the softener feeding pipe are all connected into the water containing drum of the washing machine and used for guiding fed water into the water containing drum.

Compared with the prior art, the disclosure has the following beneficial effects:

By means of the arrangement, the automatic feeding device can suck the additive into the water supply pipeline through the suction structure, the pumped additive flows to the upstream of the water supply pipeline in a countercurrent mode under the blocking action of the rising convex part arranged in the water supply pipeline, and the effect that the additive is temporarily stored in the water supply pipeline is achieved.

Meanwhile, the rising convex parts are arranged on the upstream and the downstream of the connecting position of the suction structure of the water supply pipeline respectively, so that the pumped additive is guided by the rising convex parts to flow into the upstream liquid storage cavity, countercurrent storage of the additive is achieved, and the effect that the additive flows out and flows in from the same opening of the liquid storage cavity is achieved.

Besides, the additive feeding device is provided with a plurality of water supply pipelines and water outlet branches which are connected through the opposite-flushing mechanism, so that the water stream form of the automatic feeding device is enriched, and the use effect that the automatic feeding device provides corresponding fed water streams during different washing procedures of the washing machine is achieved.

Meanwhile, the present disclosure is simple in structure, outstanding in effect and suitable for being popularized and used. The disclosure aims to provide the automatic additive feeding device so as to achieve the purpose of automatic opposite-flushing feeding of additives. Another purpose of the disclosure is to provide a washing machine to achieve the purposes of providing various forms of water streams for the water containing drum and correspondingly feeding different types of additives.

In order to achieve the purposes, the specific technical solution adopted by the disclosure is as follows:

The disclosure discloses an additive feeding device which includes a liquid storage box for containing an additive and a water path for feeding water, the water path includes a first water supply pipeline and a second water supply pipeline which are connected with the opposite-flushing mechanism and are used for respectively or simultaneously feeding water to form a plurality of fed water streams; the first water supply pipeline is connected with the liquid storage box through the suction structure, a liquid storage cavity is formed in the first water supply pipeline, and the suction structure is used for sucking the additive in the liquid storage box into the liquid storage cavity and flushing the additive to the opposite-flushing mechanism along with water fed into the first water supply pipeline so that the additive can be correspondingly fed.

Furthermore, the water path is arranged in an upper cover of the water box, the upper cover of the water box is provided with a protruding part protruding out of the rear side of the water box, at least part of the water path is arranged on the protruding part, and the water path arranged on the protruding part at least includes a first water supply pipeline and a second water supply pipeline.

Furthermore, the opposite-flushing mechanism includes a first water inlet branch and a second water inlet branch, and a first water outlet branch, a second water outlet branch and a third water outlet branch, wherein water outlet ends of the first water inlet branch and the second water inlet branch are staggered by an inclined angle and are arranged on the same side of the opposite-flushing mechanism, water inlet ends of the first water outlet branch, the second water outlet branch and the third water outlet branch are arranged on the other opposite side of the opposite-flushing mechanism; and the first water supply pipeline and the second water supply pipeline correspondingly communicate with the first water inlet branch and the second water inlet branch respectively.

Furthermore, the opposite-flushing mechanism includes a first water inlet branch and a second water inlet branch, and a first water outlet branch, a second water outlet branch and a third water outlet branch, wherein water outlet ends of the first water inlet branch and the second water inlet branch are staggered by an inclined angle and are arranged on the same side of the opposite-flushing mechanism, water inlet ends of the first water outlet branch, the second water outlet branch and the third water outlet branch are arranged on the other opposite side of the opposite-flushing mechanism; the second water supply pipe section of the water supply pipeline communicates with the water inlet end of the first water inlet branch, the water outlet end of the first water inlet branch is coaxially and oppositely spaced from the water inlet end of the first water outlet branch, and when the water supply pipeline supplies water independently, a supplied water stream is sprayed out from the water outlet end of the first water inlet branch and flows into the water inlet end of the first water outlet branch; the second water supply pipeline communicates with the water inlet end of the second water inlet branch, the water outlet end of the second water inlet branch is coaxially and oppositely spaced from the water inlet end of the second water outlet branch, and when the second water supply pipeline supplies water independently, the supplied water stream is sprayed out from the water outlet end of the second water inlet branch and flows into the water inlet end of the second water outlet branch; the water inlet end of the third water outlet branch is located between the water inlet end of the first water outlet branch and the water inlet end of the second water outlet branch, and when the water supply pipeline and the second water supply pipeline supply water at the same time, two water streams interfere with each other and are combined into the same supplied water stream which flows into the water inlet end of the third water outlet branch.

Furthermore, the opposite-flushing mechanism is arranged above the rear part of the water box, the water path below the side of the water outlet end of the water inlet branch of the opposite-flushing mechanism is provided with a notch; and the water path communicates with the interior of the water box through the notch.

Preferably, the inner wall of the water path below a gap between the side of the water outlet end of the water inlet branch and the side of the water inlet end of the water outlet branch of the opposite-flushing mechanism is an inclined plane gradually descending towards the direction of the notch.

Furthermore, an upper cover is buckled at the top of the water path, and the water path is integrated in the upper cover of the water box; the upper cover of the water box is composed of a first part and a second part which are mutually and correspondingly buckled up and down, opposite faces of the first part and the second part are respectively provided with grooves which are oppositely open and correspondingly overlapped, and the corresponding grooves define a water path after the first part and the second part are mutually buckled.

Furthermore, the contact surfaces of the first part and the second part are provided with concave and convex parts which are correspondingly connected in an inserted mode, and the concave and convex parts are used for positioning the first part and the second part in the buckling process.

Further, the suction structure includes a connecting pipeline connected with the water supply pipeline in parallel, an outlet end of the connecting pipeline is connected with the water supply pipeline through a pump for providing suction power, and the liquid storage box is connected with the middle part of the connecting pipeline through a suction pipeline; an inlet end of the connecting pipeline communicates with the water supply pipeline, and a control device for controlling the flow direction and/or on-off of liquid in the pipeline is arranged on the water supply pipeline and/or the suction pipeline and used for pumping the additive into the water supply pipeline, or enabling part of the fed water stream of the water supply pipeline to flow through the connecting pipeline to wash the pump and then converge to the downstream of the water supply pipeline.

Furthermore, the first water supply pipeline and the second water supply pipeline are correspondingly connected with a water inlet and a second water inlet of the feeding device respectively, control valves for controlling corresponding water feeding on-off are installed at the water inlet and the second water inlet respectively, or the water inlet and the second water inlet are installed on a same reversing valve, and water is fed into the water inlet and the second water inlet respectively or simultaneously.

Furthermore, the water supply pipeline includes a first water supply pipe section and a second water supply pipe section; a second opening of the liquid storage cavity is connected with the water inlet of the additive feeding device through the first water supply pipe section, and a first opening of the liquid storage cavity is connected with the opposite-flushing mechanism of the additive feeding device through the second water supply pipe section.

Furthermore, the inlet end of the connecting pipeline is connected with the water inlet of the feeding device and the first water supply pipe section through a tee joint respectively, so that the water inlet communicates with any of the connecting pipeline and the first water supply pipe section.

Preferably, a first one-way check valve is arranged on the connecting pipeline or the connecting position of the first water supply pipe section and the water inlet of the feeding device so as to control the liquid in the pipeline to only flow from the tee joint to the connecting pipeline or the first water supply pipe section; a second one-way check valve is arranged on the liquid pumping pipeline, or the connecting position of the liquid pumping pipeline and the connecting pipeline, or the connecting position of the liquid pumping pipeline and the liquid storage box so as to control the liquid in the pipeline to only flow from the liquid storage box to the connecting pipeline.

The disclosure further provides a washing machine, the additive feeding device according to any one of the above claims is installed on the washing machine, and the water supply pipeline of the additive feeding device is connected with a water containing drum of the washing machine so that the additive pumped out of the liquid storage box by the suction structure can be conveyed into the water containing drum.

Furthermore, the water outlet end of the first water outlet branch of the automatic feeding device communicates with a main washing water inlet pipe arranged on the washing machine through a main washing cavity, the water outlet end of the second water outlet branch communicates with a spraying device through a spraying opening, and the water outlet end of the third water outlet branch communicates with a softener feeding pipe arranged on the washing machine through a softener cavity; the main washing water inlet pipe, the spraying device and the softener feeding pipe are all connected into the water containing drum of the washing machine and used for guiding fed water into the water containing drum.

Compared with the prior art, the disclosure has the following beneficial effects:

Through the arrangement of the automatic feeding device, the water supply pipeline with the additive feeding function forms a fed water stream of the opposite-flushing mechanism, and the automatic feeding device can correspondingly feed the liquid additive through the opposite-flushing mechanism.

Meanwhile, due to the fact that the water supply pipeline is provided with the liquid storage cavity for pre-storing the pumped-out additive, the purpose that the additive is premixed and then fed through the opposite-flushing mechanism is achieved, the density of fed liquid flowing out of the water supply pipeline is reduced, and the device is suitable for opposite-flushing outflow.

Besides, the additive feeding device is provided with a plurality of water supply pipelines and water outlet branches which are connected through the opposite-flushing mechanism, so that the water stream form of the automatic feeding device is enriched, and the use effect that the automatic feeding device provides corresponding fed water streams during different washing procedures of the washing machine is achieved.

Meanwhile, the present disclosure is simple in structure, outstanding in effect and suitable for being popularized and used.

BRIEF DESCRIPTION OF THE DRAWINGS

The disclosure is specifically explained in combination with the attached drawings.

Figure 1:
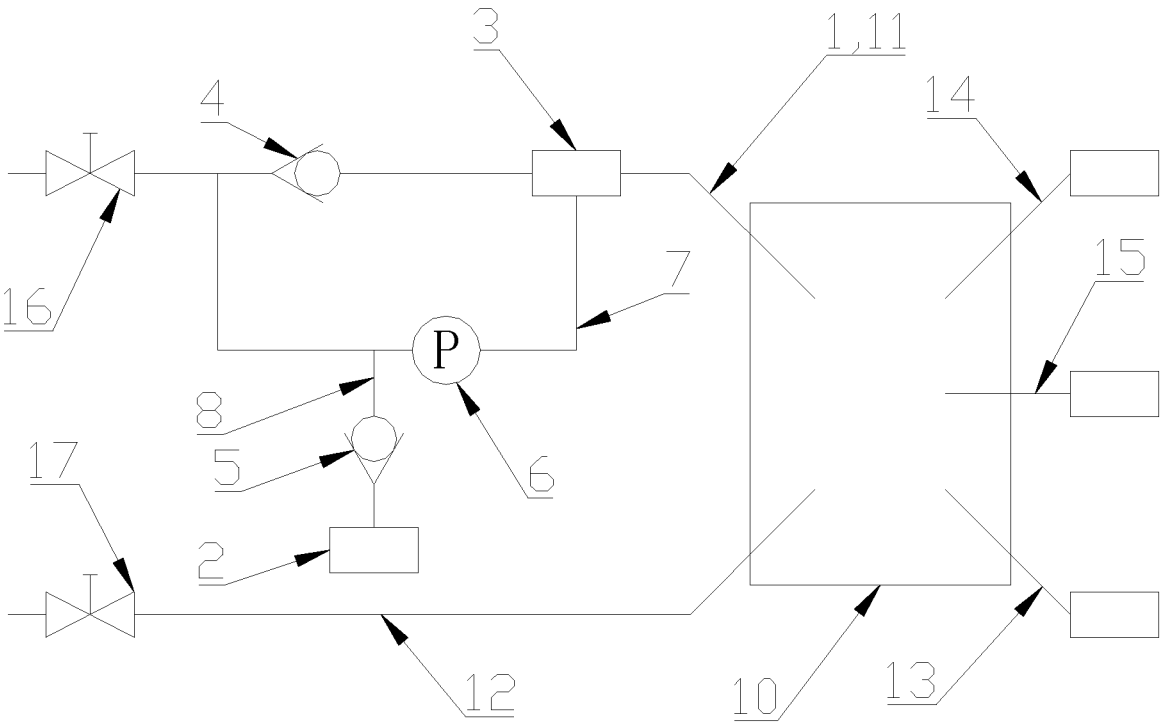
FIG. 1 is a principle schematic diagram of the automatic additive feeding device in the embodiment of the disclosure.

Description of main elements: 1—water supply pipeline, 2—liquid storage box, 3—liquid storage cavity, 4—first one-way check valve, 5—second one-way check valve, 6—pump, 7—connecting pipeline, 8—liquid pumping pipeline, 10—opposite-flushing mechanism, 11—first water supply pipeline, 12—second water supply pipeline, 13—first water outlet branch, 14—second water outlet branch, 15—third water outlet branch, 16—water inlet valve, 18—tee joint, 19—notch, 20—inclined plane, 21—first opening, 22—second opening, 23—protruding part, 24—water inlet, 25—second water inlet, 26—first water supply pipe section, 27—second water supply pipe section, 28—first water inlet branch, 29—second water inlet branch, 30—boss, 31—first rising convex part, 32—a second rising convex part, 33—pump inlet, 34—pump outlet, 100—water box, 200—upper cover and 300—water path.

DETAILED DESCRIPTION OF THE EMBODIMENTS

The embodiment of the disclosure discloses an automatic additive feeding device which is applied to an existing washing machine and used for feeding an additive into a water containing drum of the washing machine. The additive in the embodiment of the disclosure can be any one or combination of a detergent, a softener, a flavoring agent, a bleaching agent, a disinfectant and other existing liquid additives for treating clothes.

As shown in FIG. 1 to FIG. 9, the embodiment of the disclosure introduces an automatic additive feeding device, which includes a water supply pipeline 1 used for the flowing of the fed water stream of a washing machine and enabling the fed water stream to flow into a water containing drum of the washing machine; a liquid storage box 2 in which an additive is accommodated; and a suction structure which includes a power unit for providing suction power, the suction power can be provided through the power unit, the additive in the liquid storage box 2 is sucked to the water supply pipeline 1, and the fed water stream in the water supply pipeline is mixed with the pumped additive and then the additive is flushed out; and meanwhile, part of the fed water stream flows into the water supply pipeline through the suction structure so as to wash the suction structure.

In the embodiment of the disclosure, the suction structure reasonably designs the pipeline connection mode, so that only two one-way check valves are mounted, and the internal pipeline connection mode can be adjusted through mutual matching of starting and stopping of the power unit and on-off of the fed water stream; the switching use effect of pumping the additive into the water supply pipeline 1, and feeding the additive and flushing the pumping structure is achieved.

In the embodiment of the disclosure, the automatic feeding device includes at least two liquid storage boxes 2, different types of additives can be stored in the liquid storage boxes 2 respectively, and the liquid storage boxes 2 are connected with the water supply pipeline 1 through the suction structure in a selective or combined manner by a control device, so that the corresponding additive in the corresponding liquid storage box 2 flows into the water supply pipeline 1.

Embodiment 1

As shown in FIG. 1, the first embodiment introduces an additive feeding device which includes a water supply pipeline 1, a liquid storage box 2, and a suction structure. The water inlet end of the water supply pipeline 1 communicates with a water inlet structure of a washing machine so that water stream guided into the washing machine can be guided into the feeding device; the liquid storage box accommodates an additive used when the clothes are processed; and the suction structure includes a connecting pipeline which is at least partially connected with the water supply pipeline in parallel, a pump for providing suction power is arranged on the connecting pipeline, the liquid storage box is connected with the connecting pipeline, and a control device for controlling the flow direction and/or on-off of liquid in the pipeline is arranged on the water supply pipeline and/or the connecting pipeline. The additive in the liquid storage box 2 is pumped into the water supply pipeline 1, or water is fed into the water supply pipeline 1, so that the sucked additive is mixed with the fed water stream and then is fed, and part of the fed water stream is used for washing the power unit through the connecting pipeline.

In the embodiment, the suction structure includes a pump 6 providing suction power, the pump 6 is connected into the connecting pipeline in series, the end, opposite to the inlet end of the pump 6, of the connecting pipeline is a water inlet end, the end, opposite to the outlet end of the pump 6, of the connecting pipeline is an outlet end, and the water inlet end and the water outlet end of the connecting pipeline both communicate with the water supply pipeline 1. The water inlet end of the connecting pipeline is located on the upstream of the water supply pipeline compared with the water outlet end of the connecting pipeline.

In the embodiment, the liquid storage box is connected with the connecting pipeline through the liquid pumping pipeline, and the connecting part of the liquid pumping pipeline and the connecting pipeline is located between the pump inlet end and the water inlet end of the connecting pipeline, so that the liquid storage box is connected with the connecting pipeline at the upstream of the pump inlet end through the liquid pumping pipeline.

A control device is arranged on the water supply pipeline 1 and/or the connecting pipeline 7 to perform corresponding on-off switching on the water supply pipeline 1 and/or the connecting pipeline 7, so that the inlet end of the pump communicates with the liquid storage box 2 through a liquid pumping pipeline 8, and the additive is pumped into the water supply pipeline; or water is fed into the water supply pipeline, part of the fed water mixes the pumped additive through the water supply pipeline and flushes the additive to the water outlet end of the water supply pipeline, and the other part of the fed water flushes the pump through the connecting pipeline and then is combined to flow to the water outlet end of the water supply pipeline, so that the purpose of flushing and cleaning the pump is achieved.

In the embodiment, the pump 6 can be any pump structure capable of providing suction power in the prior art, such as an electromagnetic pump, a suction pump, a power pump and the like.

In the embodiment, the water supply pipeline is provided with a water inlet valve for controlling on-off of the supplied water stream, and the water inlet valve is arranged on the upstream of the communicating position of the suction structure and the water supply pipeline; preferably, the water inlet valve is arranged on the water supply pipeline at the upstream of the connecting part of the inlet end of the connecting pipeline; and preferably, the water inlet valve 16 is arranged at the water inlet end of the water supply pipeline 1. Therefore, controllable opening and closing control of the fed water stream of the water supply pipeline 1 is achieved, on and off of the fed water stream of the water supply pipeline 1 are matched with opening and closing of the pump 6, and the purpose of improving the detergent feeding efficiency is achieved.

In the embodiment, when the pump works, the water inlet valve is closed, so that when the additive in the liquid storage box is pumped into the water supply pipeline, water is stopped from entering the water supply pipeline, the pump is prevented from pumping fed water flowing into the upstream of the water supply pipeline from the connecting pipeline, and the situation that the additive cannot be pumped out is prevented; and meanwhile, when the water inlet valve is opened, the pump stops working, so that part of the fed water stream flows through the connecting pipeline to flush the pump which stops working and is located at a communicating pipe section, and the phenomenon that additive remains in the pump and the connecting pipeline is avoided.

In the embodiment, in order to achieve on-off switching of the liquid pumping pipeline 8 and the connecting pipeline 7, the control device can be arranged in any mode in the prior art, for example, control valves for controlling on-off of the pipelines are arranged on the water supply pipeline 1 and the connecting pipeline 7 respectively, and the inlet end of the pump 6 alternatively communicates with the water supply pipeline 1 and the liquid pumping pipeline 8 through a reversing valve.

In the embodiment, in order to reduce the cost of the feeding device, the control device on the water supply pipeline 1 and/or the connecting pipeline 8 is arranged as follows:

In the embodiment, the water supply pipeline 1 is provided with a first one-way check valve 4, and the first one-way check valve 4 is located between the inlet end of the connecting pipeline 7 and the outlet end of the connecting pipeline 7; and the liquid pumping pipeline 8 is provided with a second one-way check valve 5 for controlling liquid in the pipeline to only flow from the liquid storage box 2 to the inlet end of the pump 6.

Therefore, when the pump 6 works, a water inlet valve of the water supply pipeline 1 is disconnected to stop water feeding, a suction acting force is formed at the inlet end of the pump 6, and an additive in the liquid storage box 2 is sucked in and fed into the water supply pipeline 1 through the liquid suction pipeline 8 and cannot flow to the water inlet end of the connecting pipeline under the action of the first one-way check valve 4 arranged on the water supply pipeline. The condition that the additive sucked into the water supply pipeline flows back to the connecting pipeline is avoided. Meanwhile, when the pump 6 does not work, a water inlet valve of the water supply pipeline 1 is opened to start water feeding, the pump 6 forms a communicating pipeline through which the water stream flows freely, part of the fed water directly flows into the water supply pipeline 1, and part of the fed water flows along the pump and the connecting pipeline 8 and then converges to the downstream of the water supply pipeline 1, so that the effect of flushing the pump 6 is achieved; and in the process, the liquid pumping pipeline 8 is disconnected under the action of the second one-way check valve 5, so that the water stream is prevented from flowing into the liquid storage box 2.

In the embodiment, in order to ensure that the additive is pumped into the water supply pipeline 1 and does not flow back, the following arrangement is made: the water supply pipeline 1 is provided with a liquid storage cavity 3 for temporarily storing the additive pumped into the water supply pipeline 1 by a pump 6. The liquid storage cavity 3 is connected into the water supply pipeline 1 in series and located between the water inlet end of the connecting pipeline and the water outlet end of the connecting pipeline. Preferably, the outlet end of the pump 6 directly communicates with the liquid storage cavity 3 or communicates with the liquid storage cavity 3 through the water outlet end of the connecting pipeline 8. Further preferably, the outlet end of the pump 6 communicates with the upper part of the liquid storage cavity 3, so that the additive pumped into the liquid storage cavity 3 flows in from the upper part of the cavity to avoid backflow; the water supply pipeline 1 penetrates through the bottom of the side wall of the liquid storage cavity 3 and communicates with the liquid storage cavity 3, so that the water stream provided by the water supply pipeline 1 can flush the bottom of the liquid storage cavity 3, and the additive pumped into the cavity can be completely flushed to the water outlet end of the water supply pipeline 1 by the fed water stream of the water supply pipeline 1. Further preferably, in order to guarantee the operation stability of the whole device, the liquid storage cavity 3 is arranged to be a sealed cavity.

In the embodiment of the disclosure, the specific feeding working process of the additive feeding device is as follows:

Firstly, the water inlet valve of the water supply pipeline 1 is closed, the pump 6 is started, at the moment, a suction force is formed at the inlet end of the pump 6, and the additive in the liquid storage box 2 is pumped to the pump 6 along the liquid pumping pipeline 8 and then flows into the liquid storage cavity 3 formed in the water supply pipeline 1 through the connecting pipeline 7; in the process, the water supply pipeline 1 cannot make the additive pumped into the water supply pipeline 1 flow to the water inlet end of the connecting pipeline 7 under the action of the first one-way check valve 4, so that the condition that the additive circularly flows between the connecting pipeline and the water supply pipeline is prevented;

Then, the water inlet valve of the water supply pipeline 1 is opened, the pump 6 is closed, at the moment, the pump 6 forms a communicating pipeline through which the water stream flows freely, part of the fed water stream in the water supply pipeline 1 flows into the liquid storage cavity 3, and the additive in the liquid storage cavity 3 is directly flushed into the downstream of the water supply pipeline 1; and the other part of the fed water stream flows along the pump 6 and the connecting pipeline 7 and then converges to the downstream of the water supply pipeline 1, in the process, the fed water stream passing through the connecting pipeline 7 flushes the pump 6, and under the action of the second one-way check valve 5, the fed water stream passing through the connecting pipeline 7 cannot flow into the liquid storage box 2 through the liquid pumping pipeline 8.

By means of the above mode, the purposes of sucking and feeding the additive and flushing and cleaning the pump of the sucking device are achieved, and then the effect of automatically feeding the additive is achieved on the premise that the production cost is reduced; meanwhile, in the operation process of the additive feeding device, the technical solution that flushing is conducted in time after the additive is fed is adopted, it is avoided that the additive remains in the feeding device, and particularly the situation that corrosion damage is caused due to the fact that the additive remains in a power part of the additive feeding device is prevented from occurring.

As shown in FIG. 1, the embodiment introduces an additive feeding device which includes a first water supply pipeline 11 and a second water supply pipeline 12 which are connected in parallel, the first water supply pipeline 11 is provided with a suction structure for sucking an additive in a liquid storage box 2 into the pipeline, and the suction structure can suck the additive in the liquid storage box 2 into the water supply pipeline 1.

In the embodiment, a suction structure can be connected to the second water supply pipeline, and the suction structure can be independently arranged and can also be shared with the first water supply pipeline, so that the function of automatically feeding the additive by using the second water supply pipeline is realized.

In the embodiment, the first water supply pipeline 11 and the second water supply pipeline 12 communicate with any one of the multiple water outlet branches in a reversing mode through the opposite-flushing mechanism 10, and the water outlet branches are connected with different water inlet structures of the water containing drums of the washing machine respectively so that the fed water of the washing machine can be conveyed to a water inlet device of any water containing drum. Therefore, the purpose of supplying water to different water inlet structures is achieved. The water inlet device of the water containing drum can be any existing structure, for example, a spraying structure for spraying water into the water containing drum, a main washing water inlet cavity allowing detergent and/or washing powder to flow into the water containing drum, an auxiliary washing water inlet cavity allowing softener and other auxiliary additives to flow into the water containing drum and the like.

In the embodiment, in order to achieve the effects, the following arrangement is made: the water outlet ends of the first water supply pipeline 11 and the second water supply pipeline 12 are arranged on the same side of the opposite-flushing mechanism 10 in a staggered mode by an inclined angle, and the water inlet ends of the first water outlet branch 13, the second water outlet branch 14 and the third water outlet branch 15 are located on the other side of the opposite-flushing mechanism 10. By arranging the water supply pipelines and the water outlet branches which are connected through the opposite-flushing mechanism on the additive feeding device, the water stream form of the automatic feeding device is enriched, and the using effect that the automatic feeding device provides corresponding fed water streams in different washing procedures of the washing machine is achieved.

In the embodiment, the water outlet end of the first water supply pipeline 11 is coaxially and oppositely spaced from the water inlet end of the first water outlet branch 13, and when the first water supply pipeline 11 supplies water independently, the fed water stream is sprayed out from the water outlet end of the first water supply pipeline 11 and flows into the water inlet end of the first water outlet branch 13; the water outlet end of the second water supply pipeline 12 is coaxially and oppositely spaced from the water inlet end of the second water outlet branch 14, and when the second water supply pipeline 12 supplies water independently, the fed water stream is sprayed out from the water outlet end of the second water supply pipeline 12 and flows into the water inlet end of the second water outlet branch 14; the water inlet end of the third water outlet branch 15 is located between the water inlet end of the first water outlet branch 13 and the water inlet end of the second water outlet branch 14, when the first water supply pipeline 1 and the second water supply pipeline 1 supply water at the same time, two water streams interfere with each other and are combined into the same supplied water stream, and the supplied water stream flows into the water inlet end of the third water outlet branch 15. Preferably, in order to ensure that the converged water stream accurately flows into the third water outlet branch, the axis of the water inlet end of the third water outlet branch is arranged along the center line of the water inlet end of the first water outlet branch and the water inlet end of the second water outlet branch.

The embodiment also introduces a washing machine which is characterized in that the additive feeding device is installed, and the water supply pipeline 1 of the additive feeding device is connected with a water containing drum of the washing machine so that the additive pumped out of the liquid storage box 2 by the suction structure can be conveyed into the water containing drum.

The washing machine in the embodiment is provided with the spraying device for spraying water into the water containing drum, the softener feeding opening for feeding the softener into the water containing drum and the washing feeding opening for feeding the washing agent or washing powder into the water containing drum. The water outlet end of the first water outlet branch 13 of the additive feeding device communicates with the washing feeding opening, the water outlet end of the second water outlet branch 14 communicates with the spraying device, and the water outlet end of the third water outlet branch 15 communicates with the softener feeding opening.

Embodiment 2

As shown in FIG. 2 to FIG. 9, an additive feeding device is introduced in the embodiment and includes a water box 100; a liquid storage box 2 for accommodating an additive is mounted in the water box 100; a water path 300 is integrated on the water box 100; preferably, the top of the water path 300 is buckled with an upper cover 200, and the water path 300 is integrated in the upper cover 200 of the water box 100; more preferably, the upper cover 200 of the water box is composed of a first part and a second part which are mutually and correspondingly buckled up and down, opposite surfaces of the first part and the second part are respectively provided with grooves which are oppositely open and correspondingly overlapped, so that a water path 300 is defined by the corresponding grooves after the first part and the second part are mutually buckled.

In the embodiment, the water path 300 of the additive feeding device includes a water supply pipeline 1 for introducing fed water of the feeding device and a connecting pipeline 7 which is at least partially connected with the water supply pipeline 1 in parallel; a pump 6 which is connected into the connecting pipeline 7 in series is mounted on the water box 100; the liquid storage box 2 is connected with the connecting pipeline 7 through a liquid pumping pipeline 8 penetrating through the water box 100, and the water supply pipeline 1 and/or the connecting pipeline 7 are/is provided with a control device for controlling the flowing direction and/or the on-off of liquid in the pipeline. The additive in the liquid storage box 2 is pumped into the water supply pipeline 1 by utilizing the suction force of the pump 6, or water is supplied into the water supply pipeline 1 to feed the pumped additive and wash the pump 6.

According to the embodiment, a liquid storage cavity 3 which forms an independent cavity in a surrounding mode is installed on the water box 100, and the liquid storage cavity 3 is connected into the water supply pipeline 1 in series; preferably, the liquid storage cavity 3 is formed in the outer side of the water box 100, a first opening 21 is formed in the top of the liquid storage cavity 3, the first opening 21 is connected with the water supply pipeline 1, and at the same time the first opening 21 is used for pumping the additive in the water supply pipeline 1 to flow into the liquid storage cavity 3 and enabling a mixture of the additive and water in the liquid storage cavity 3 to flow out to the water supply pipeline 1; further preferably, the liquid storage cavity 3 is further provided with another second opening 22 which communicates with the water supply pipeline 1, so that the fed water flowing into the water supply pipeline 1 flows into the liquid storage cavity 3, and the fed water is premixed with a temporarily stored additive in the liquid storage cavity 3 to form a mixture of the additive and the water.

The liquid storage cavity connected with the water supply pipeline in series is formed in the water box, so that an additive pumped into the water supply pipeline is mixed with fed water in the water supply pipeline and then fed, the additive is premixed, and the density of liquid flowing to the opposite-flushing mechanism is reduced; therefore, the effect that the liquid flowing out of the water supply pipeline can serve as one path of water stream to form an opposite-flushing water stream at the opposite-flushing structure is achieved.

In the embodiment, the water supply pipeline 1 includes a first water supply pipe section 26 and a second water supply pipe section 27, the first water supply pipe section 26 is used for connecting the liquid storage cavity 3 with a water inlet 24 of the feeding device, and the second water supply pipe section 27 is used for connecting the liquid storage cavity 3 with the opposite-flushing mechanism 10. The additive and water mixture in the liquid storage cavity flows to the opposite-flushing mechanism along with the fed water of the water supply pipeline to be correspondingly fed.

In the embodiment, one end of a connecting pipeline 7 is connected with a water inlet 24 of the feeding device, the other end of the connecting pipeline 7 is connected with a pump inlet 33 of the pump 6, and a pump outlet 34 of the pump 6 is connected with the middle part of the second water supply pipe section 27 of the water supply pipeline 1; and the middle part of the connecting pipeline 7 is connected with the liquid storage box 2 through the liquid pumping pipeline 8. By means of the arrangement, the opening, connected with the second water supply pipe section, of the liquid storage cavity has the dual functions of allowing the additive pumped into the water supply pipeline to flow in and allowing mixed liquid of the additive and fed water in the liquid storage cavity to flow out at the same time.

In the embodiment, a water inlet 24 of the feeding device is respectively connected with the connecting pipeline 7 and the first water supply pipe section 26 through a tee joint 18, so that the water inlet 24 communicates with any of the connecting pipeline 7 and the first water supply pipe section 26.

In the embodiment, a first one-way check valve 4 is arranged at the connecting part of the first water supply pipe section 26 and the water inlet 24 of the feeding device water, the liquid in a pipeline is controlled to only flow from the tee joint 18 to the first water supply pipe section 26, and the situation that the liquid in the water supply pipeline 1 flows to the connecting pipeline 7 through the tee joint 18 under the suction force of the pump 6 is prevented.

In the embodiment, a second one-way check valve 5 is arranged on the liquid pumping pipeline 8, or at the connecting part of the liquid pumping pipeline 8 and the connecting pipeline 7, or at the connecting part of the liquid pumping pipeline 8 and the liquid storage box 2, and the liquid in the pipeline is controlled to only flow from the liquid storage box 2 to the connecting pipeline 7. Preferably, the second one-way check valve 6 is arranged at the connecting part of the liquid storage box 2 and the liquid pumping pipeline 8.

In the embodiment, a water path 300 is arranged in an upper cover 200 of the water box 100, the upper cover 200 of the water box is provided with a protruding part 23 protruding out of the rear side of the water box 100, at least part of the water path 300 is arranged at the protruding part 23, and the water path 300 arranged at the protruding part 23 at least includes a water supply pipeline 1 and a connecting water path 7.

In the embodiment, the pump 6 is mounted on the outer side of the water box 100 and below the protruding part 23 of the water box upper cover 200; the liquid storage cavity 3 is arranged in the water box 100 and located on the rear side of the water box 100. Certainly, the liquid storage cavity 3 can be arranged in a gap between the pump 6 and the rear side of the water box 100.

In the embodiment, the water path 300 on the water box 100 further includes a second water supply pipeline 12, one end of the second water supply pipeline 12 is connected with a second water inlet 25 of the feeding device, the other end of the second water supply pipeline 12 is connected with the opposite-flushing mechanism 10, and a water inlet 24 and the second water inlet 25 of the feeding device are respectively provided with a control valve for controlling the on-off of corresponding fed water or are arranged on the same reversing valve. Water is fed into the water inlet 24 and the second water inlet 25 respectively or simultaneously.

In the embodiment, the opposite-flushing mechanism 10 includes a first water inlet branch28 and a second water inlet branch 29, and a first water outlet branch 13, a second water outlet branch14 and a third water outlet branch 15, wherein water outlet ends of the first water inlet branch 28 and the second water inlet branch 29 are staggered by an inclined angle and are arranged on the same side of the opposite-flushing mechanism 10, water inlet ends of the first water outlet branch 13, the second water outlet branch 14 and the third water outlet branch 15 are arranged on the other opposite side of the opposite-flushing mechanism 10. A second water supply pipe section 27 of the water supply pipeline 1 communicates with the water inlet end of the first water inlet branch 28, the water outlet end of the first water inlet branch 28 is coaxially and oppositely spaced from the water inlet end of the first water outlet branch 13, and when the water supply pipeline 1 supplies water independently, the supplied water stream is sprayed out from the water outlet end of the first water inlet branch 28 and flows into the water inlet end of the first water outlet branch 13. The second water supply pipeline 12 communicates with the water inlet end of the second water inlet branch 29, the water outlet end of the second water inlet branch 29 is coaxially and oppositely spaced from the water inlet end of the second water outlet branch 14, and when the second water supply pipeline 12 supplies water independently, the supplied water stream is sprayed out from the water outlet end of the second water inlet branch 29 and flows into the water inlet end of the second water outlet branch 14. The water inlet end of the third water outlet branch 15 is located between the water inlet end of the first water outlet branch 13 and the water inlet end of the second water outlet branch 14, when the water supply pipeline 1 and the second water supply pipeline 12 supply water at the same time, two water streams interfere with each other and are combined into the same supplied water stream, and the supplied water stream flows into the water inlet end of the third water outlet branch 15.

According to the embodiment, the opposite-flushing mechanism 10 is arranged above the rear portion of the water box, the water path below the side of the water outlet end of the water inlet branch of the opposite-flushing mechanism 10 is provided with the notch 19, the notch 19 enables the water way to communicate with the interior of the water box so that the liquid splashed at the opposite-flushing mechanism can flow into the water box from the notch, and the situation that the opposite flushing is interfered due to the fact that residual water appears at the opposite-flushing mechanism is avoided. Preferably, the inner wall of the water path below the gap between the side of the water outlet end of the water inlet branch and the side of the water inlet end of the water outlet branch of the opposite-flushing mechanism is an inclined plane 20 gradually descending towards the direction of the notch.

In the embodiment, the water outlet end of the first water outlet branch 13 is provided with a washing feeding opening communicating with a main washing cavity in the water box 100, the water outlet end of the second water outlet branch 14 communicates with a spraying opening which is formed in the water box 100 and communicates with the outside, and the water outlet end of the third water outlet branch 15 is connected with a softener throwing opening communicating with a softener cavity in the water box 100.

Embodiment 3

As shown in FIG. 2 to FIG. 9, the embodiment introduces an additive feeding device which includes a liquid storage box 2 for containing an additive, a water path 300 for water feeding and a suction structure for pumping the additive in the liquid storage box 2 into the water path 300, a liquid storage cavity 3 which is connected in series is formed in the water path 300, an opening is formed in the liquid storage cavity 3, the additive pumped into the water path 300 flows in from the opening for temporary storage, and the additive in the liquid storage cavity 3 flows out after being mixed with the fed water.

The liquid storage cavity connected with the water supply pipeline in series is formed in the water box, so that an additive pumped into the water supply pipeline is mixed with fed water in the water supply pipeline and then fed, the additive is premixed, and the density of liquid flowing to the opposite-flushing mechanism is reduced; therefore, the effect that the liquid flowing out of the water supply pipeline can serve as one path of water stream to form opposite-flushing water stream at the opposite-flushing structure is achieved.

In the embodiment, the liquid storage cavity 3 is provided with a first opening 21, the first opening 21 is connected with the opposite-flushing mechanism 10 through a second water supply pipe section 27, the second water supply pipe section 27 communicates with the connecting water path 7 through the pump 6, and the connecting water path 7 communicates with the liquid storage box 2 through the liquid pumping pipeline 8. By means of the arrangement, the opening, connected with the second water supply pipe section, of the liquid storage cavity has the dual functions of allowing the additive pumped into the water supply pipeline to flow in and allowing mixed liquid of the additive and fed water in the liquid storage cavity to flow out at the same time.

In the embodiment, a second one-way check valve 5 is arranged on the liquid pumping pipeline 8, or the connecting part of the liquid pumping pipeline 8 and the connecting pipeline 7, or the connecting part of the liquid pumping pipeline 8 and the liquid storage box 2, and the liquid in the pipeline is controlled to only flow from the liquid storage box to the connecting pipeline.

In the embodiment, in order to achieve flushing of the pump 6 which stops working after additive suction is completed, the connecting pipeline 7 communicates with the first water supply pipe section 26, so that part of inflow water flows through the connecting pipeline to flush the pump 6 and then converges into the downstream of the water supply pipeline 1. Meanwhile, in order to prevent a pump from pumping liquid in the water supply pipeline 1 into the connecting pipeline 7, a first one-way check valve 4 is arranged on the water supply pipeline 1, and the first one-way check valve 4 is located at the end, communicating with the water inlet 24, of the first water supply pipe section 26.

In the embodiment, the liquid storage cavity 3 is provided with a second opening 22, and the second opening 22 communicates with the water inlet 24 of the feeding device through the first water supply pipe section 26 and used for guiding the fed water in the water supply pipeline 1 into the liquid storage cavity 3, so that the temporarily stored additive and the fed water stream are premixed to form an additive and water mixture; along with the increase of the fed water stream, the mixture flows into the second water supply pipe section 27 from the first opening 21 and then is fed through the opposite-flushing mechanism 10; preferably, the connecting pipeline 7 communicates with a first water supply pipe section 26, a first one-way check valve 4 is arranged on the first water supply pipe section 26, and liquid in the pipeline is controlled to only flow towards the liquid storage cavity 3.

In the embodiment of the disclosure, the liquid storage cavity 3 is arranged in the water box 100 and is close to the rear side wall of the water box 100, so that the liquid storage cavity 3 cannot generate interference influence on the liquid storage box 2 which is pulled outwards; meanwhile, the liquid storage cavity 3 is arranged at the rear part of the water box 100, so that the distance between the water path part arranged on the protruding part 23 of the upper cover 200 and the liquid storage cavity 3 is not too far, and the smoothness of the water stream is ensured.

Embodiment 4

Figure 2:
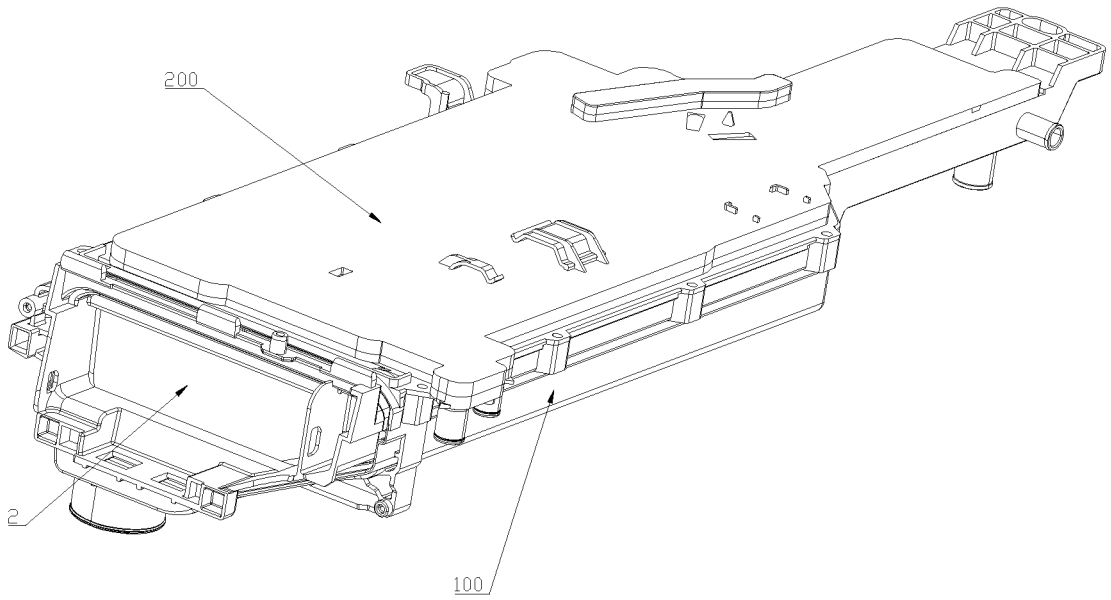
FIG. 2 is a structural schematic diagram of the automatic additive feeding device in the embodiment of the disclosure.
Figure 3:
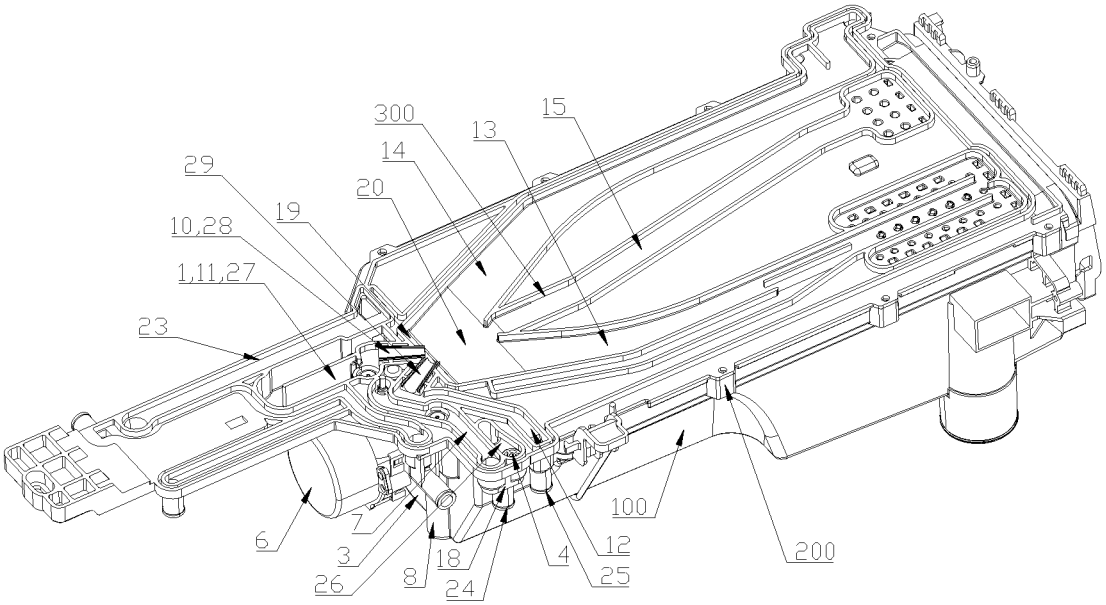
FIG. 3 to FIG. 6 are structural schematic diagrams of the automatic additive feeding device from different visual angles after the top surface is removed.
Figure 4:
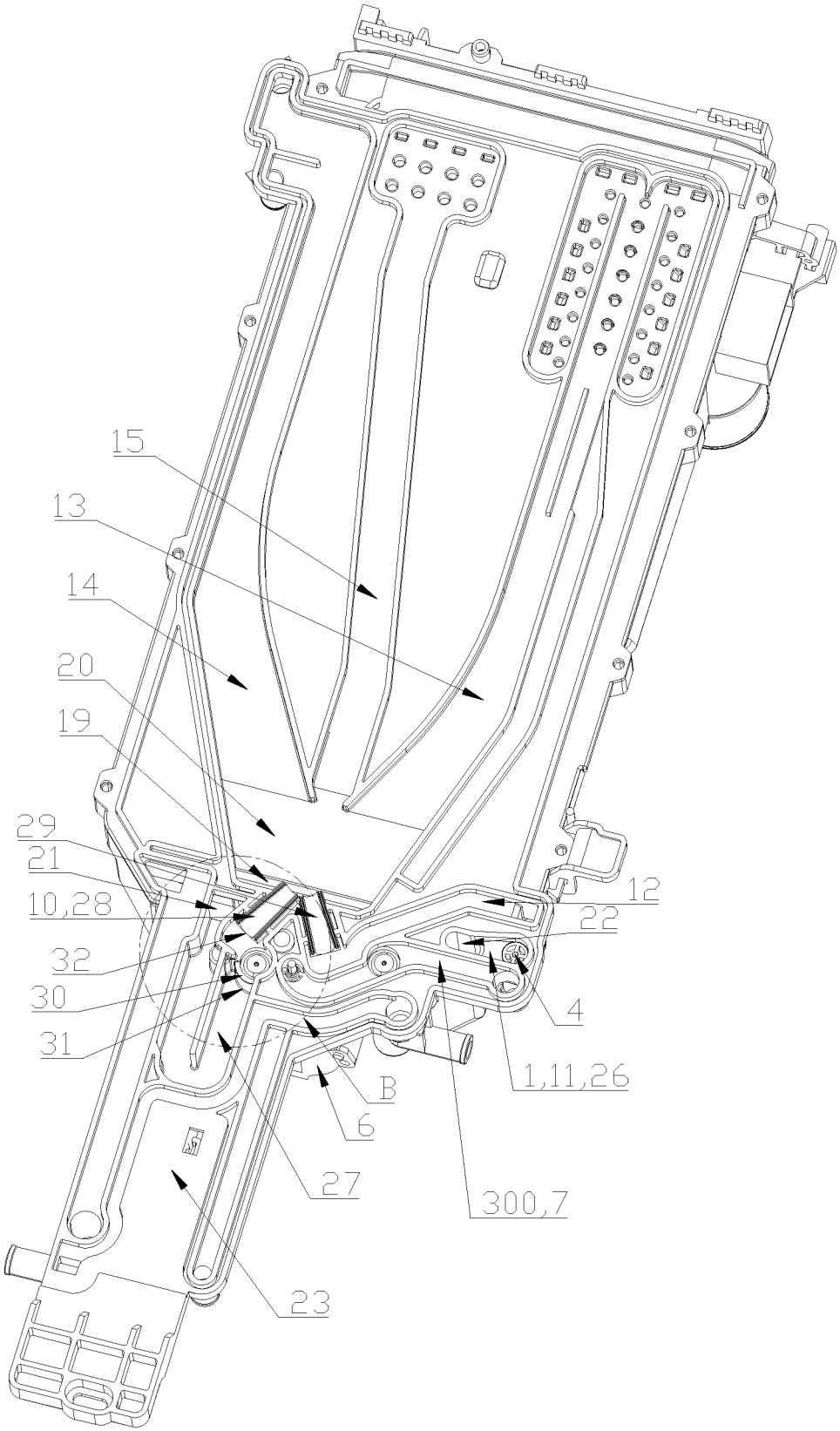
Figure 5:
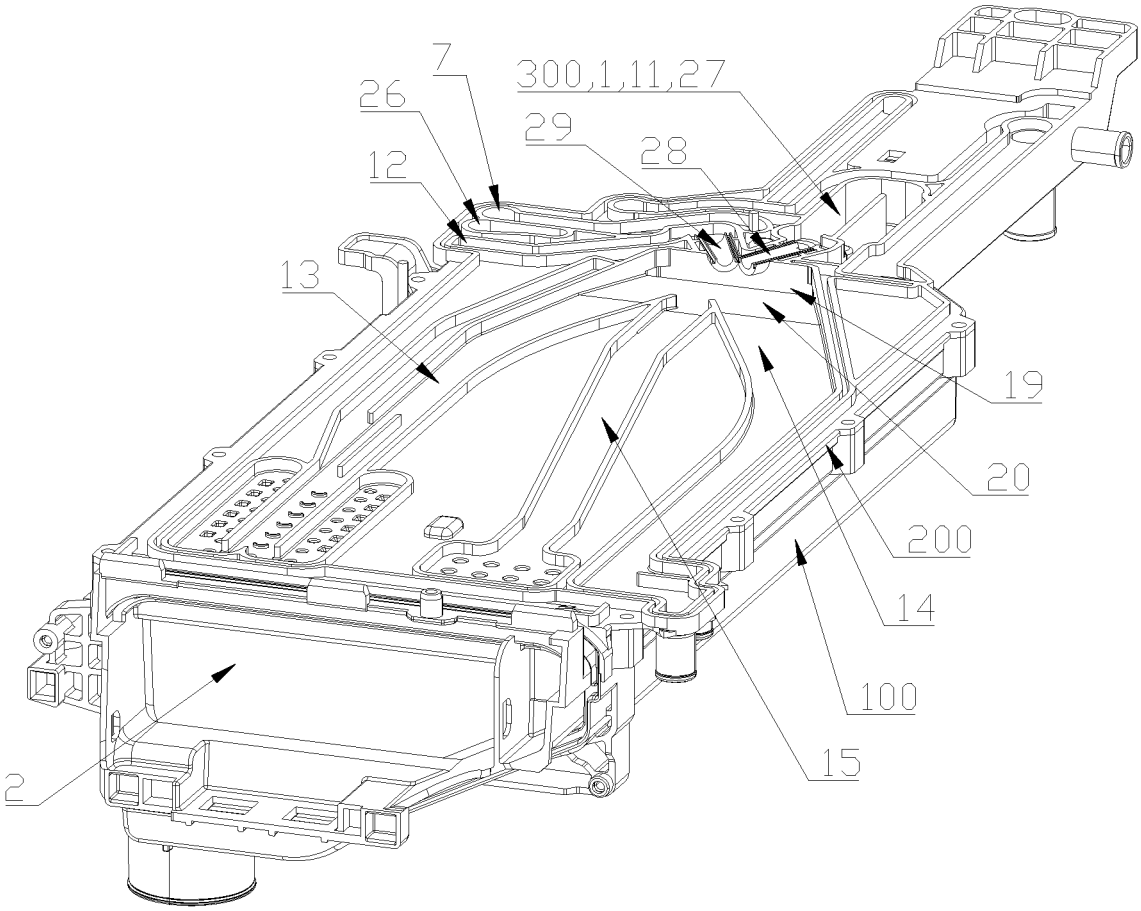
Figure 6:
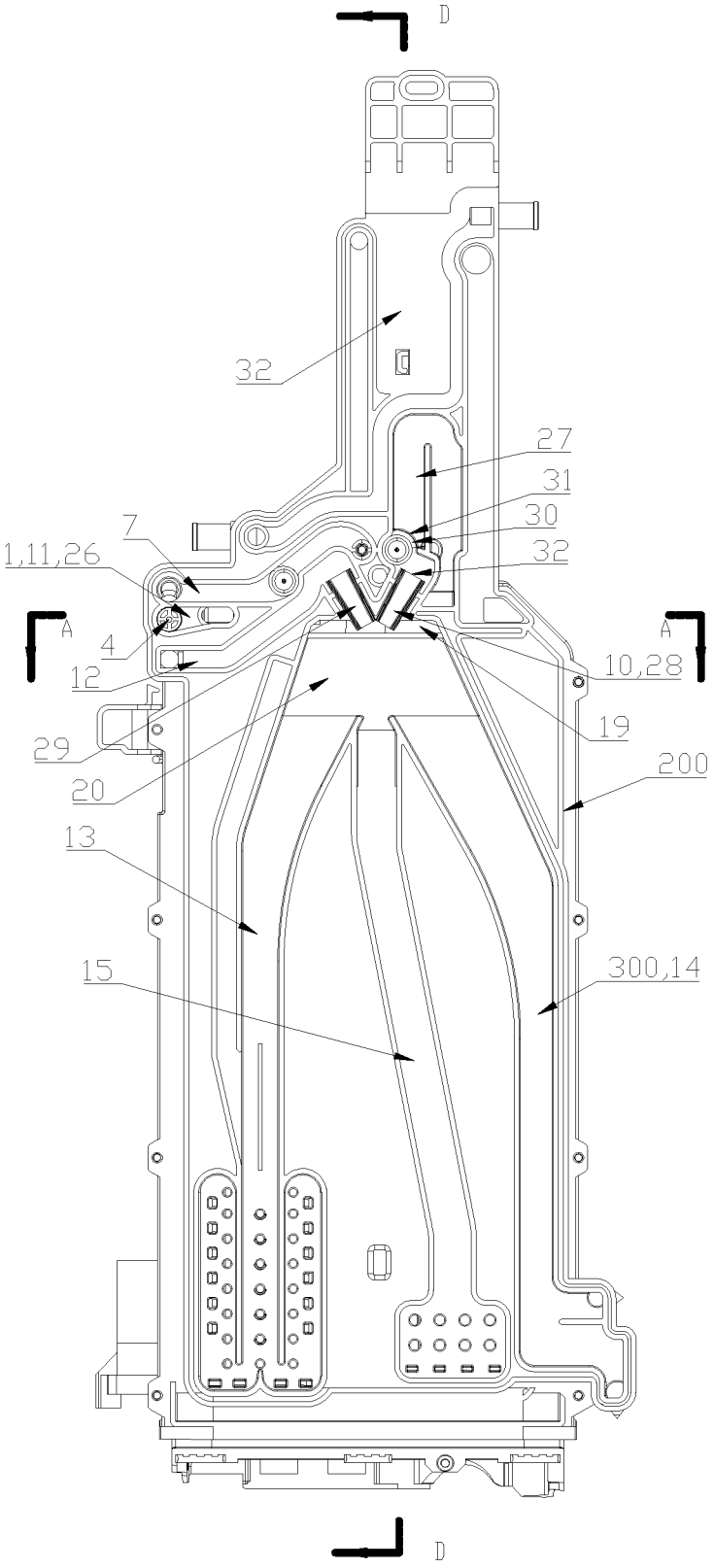
Figure 7:
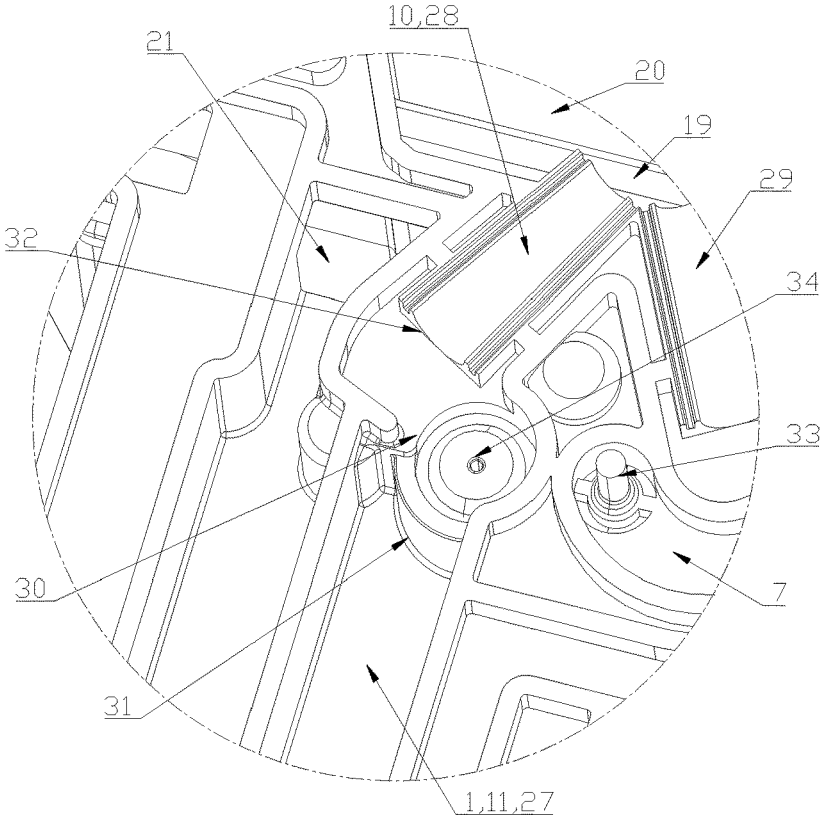
FIG. 7 is a schematic diagram of a magnified structure at the position B of FIG. 4 in the embodiment of the disclosure.
Figure 8:
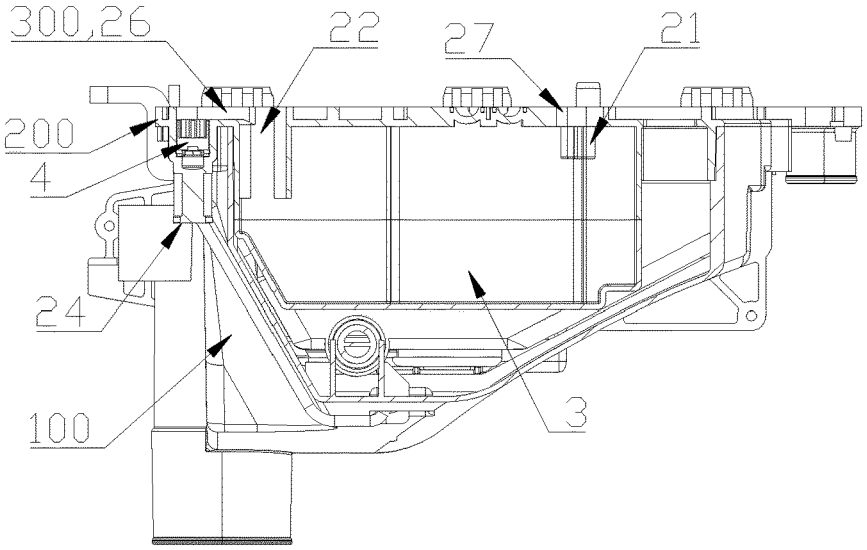
FIG. 8 is a schematic diagram of an A-A section structure in FIG. 6 in the embodiment of the disclosure.
Figure 9:
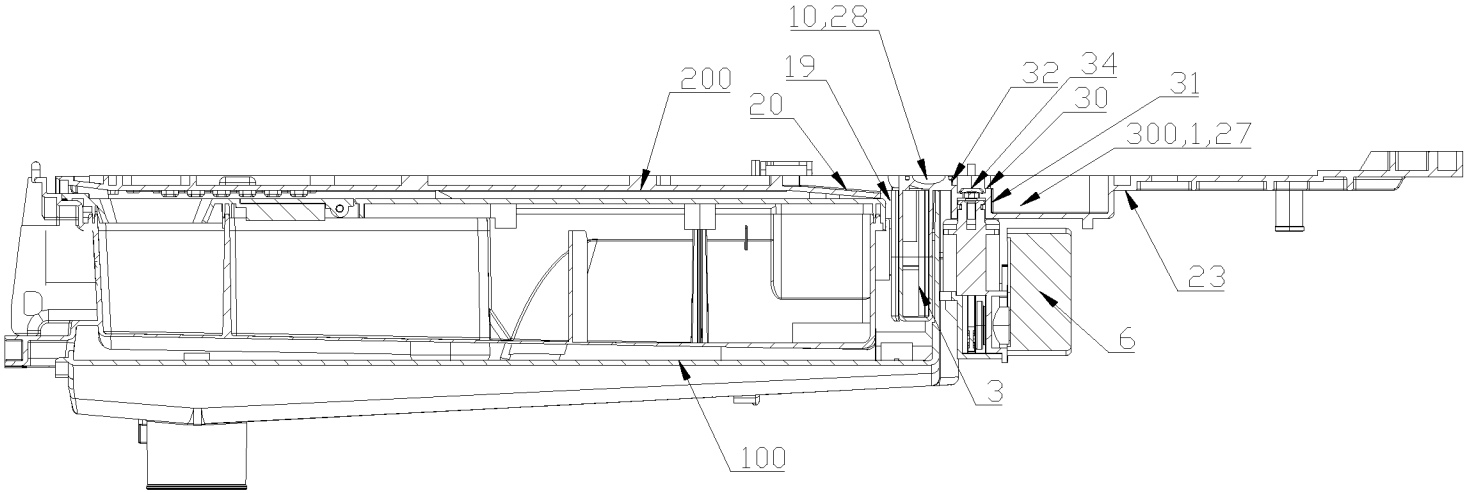
FIG. 9 is a schematic diagram of a D-D section structure in FIG. 6 in the embodiment of the disclosure.

As shown in FIG. 9 in FIG. 2, the embodiment introduces an additive feeding device which includes a liquid storage box 2 for containing an additive and a water path 300 for water feeding, the water path 300 includes a first water supply pipeline 11 and a second water supply pipeline 12 which are connected with the opposite-flushing mechanism 10 and are used for respectively or simultaneously feeding water to form a plurality of fed water streams; the first water supply pipeline 11 is connected with the liquid storage box 2 through a suction structure, a liquid storage cavity 3 is formed in the first water supply pipeline 11, and the suction structure is used for sucking an additive in the liquid storage box 2 into the liquid storage cavity 3 and flushing the additive to the opposite-flushing mechanism 10 along with water entering the first water supply pipeline 11 so as to carry out corresponding feeding.

Through the arrangement of the additive feeding device, the water supply pipeline with the additive feeding function forms a path of fed water stream of the opposite-flushing mechanism, and the additive feeding device can correspondingly feed the liquid additive through the opposite-flushing mechanism; meanwhile, due to the fact that the water supply pipeline is provided with the liquid storage cavity for pre-storing the pumped-out additive, the purpose that the additive is premixed and then fed through the opposite-flushing mechanism is achieved, the density of fed liquid flowing out of the water supply pipeline is reduced, and the device is suitable for opposite flushing and flowing out.

In the embodiment, the water path 300 is arranged in the water box upper cover 200, the water box upper cover 200 is provided with a protruding part 23 protruding out of the rear side of the water box 100, at least part of the water path 300 is arranged on the protruding part 23, and the water path 300 arranged on the protruding part 23 at least includes a first water supply pipeline 11 and a second water supply pipeline 12.

In the embodiment, the opposite-flushing mechanism 10 includes a first water inlet branch 28 and a second water inlet branch 29, and a first water outlet branch 13, a second water outlet branch14 and a third water outlet branch 15, wherein water outlet ends of the first water inlet branch 28 and the second water inlet branch 29 are staggered by an inclined angle and are arranged on the same side of the opposite-flushing mechanism 10, water inlet ends of the first water outlet branch 13, the second water outlet branch 14 and the third water outlet branch 15 are arranged on the other opposite side of the opposite-flushing mechanism 10. A second water supply pipe section 27 of the water supply pipeline 1 communicates with the water inlet end of the first water inlet branch 28, the water outlet end of the first water inlet branch 28 is coaxially and oppositely spaced from the water inlet end of the first water outlet branch 13, and when the water supply pipeline 1 supplies water independently, the supplied water stream is sprayed out from the water outlet end of the first water inlet branch 28 and flows into the water inlet end of the first water outlet branch 13. The second water supply pipeline 12 communicates with the water inlet end of the second water inlet branch 29, the water outlet end of the second water inlet branch 29 is coaxially and oppositely spaced from the water inlet end of the second water outlet branch 14, and when the second water supply pipeline 12 supplies water independently, the supplied water stream is sprayed out from the water outlet end of the second water inlet branch 29 and flows into the water inlet end of the second water outlet branch 14. The water inlet end of the third water outlet branch 15 is located between the water inlet end of the first water outlet branch 13 and the water inlet end of the second water outlet branch 14, when the water supply pipeline 1 and the second water supply pipeline 12 supply water at the same time, two water streams interfere with each other and are combined into the same supplied water stream, and the supplied water stream flows into the water inlet end of the third water outlet branch 15.

According to the embodiment, the opposite-flushing mechanism 10 is arranged above the rear portion of the water box, the water path below the side of the water outlet end of the water inlet branch of the opposite-flushing mechanism 10 is provided with the notch 19, the notch 19 enables the water way to communicate with the interior of the water box so that the liquid splashed at the opposite-flushing mechanism can flow into the water box from the notch, and the situation that the opposite flushing is interfered due to the fact that residual water appears at the opposite-flushing mechanism is avoided. Preferably, the inner wall of the water path below the gap between the side of the water outlet end of the water inlet branch and the side of the water inlet end of the water outlet branch of the opposite-flushing mechanism is an inclined plane 20 gradually descending towards the direction of the notch.

In the embodiment, the water outlet end of the first water outlet branch 13 is provided with a washing feeding opening communicating with a main washing cavity in the water box 100, the water outlet end of the second water outlet branch 14 communicates with a spraying opening which is formed in the water box 100 and communicates with the outside, and the water outlet end of the third water outlet branch 15 is connected with a softener throwing opening communicating with a softener cavity in the water box 100.

Embodiment 5

As shown in FIG. 9 in FIG. 2, the embodiment introduces an additive feeding device which includes a water supply pipeline 1, the water supply pipeline 1 is provided with a rising convex part for increasing the height of a water path in the fed water direction, and the water supply pipeline 1 on the upstream of the rising convex part is connected with a liquid storage box 2 through a suction structure, and the additive pumped into the water supply pipeline 1 flows to the upstream of the water supply pipeline 1 in a countercurrent mode under the blocking action of the rising convex part.

According to the embodiment, the liquid storage cavity 3 is connected to the water supply pipeline 1 in series, and the liquid storage cavity 3 is located on the water supply pipeline 1 on the upstream of the connecting position of the liquid storage cavity 3 and the suction structure, so that the additive flowing in a countercurrent mode enters the liquid storage cavity 3 to be temporarily stored under the effect of the rising convex part.

In the embodiment, the water supply pipeline 1 includes a first water supply pipe section 26 and a second water supply pipe section 27, the liquid storage cavity 3 communicates with the water inlet 24 of the additive feeding device through the first water supply pipe section 26, and the liquid storage cavity 3 is connected with the opposite-flushing mechanism 10 through the second water supply pipe section 27, so that the fed water stream flows to the opposite-flushing mechanism 10 after flowing through the liquid storage cavity 3.

In the embodiment of the disclosure, the suction structure is connected with the second water supply pipe section 27 so as to feed the pumped additive into the second water supply pipe section 27. The second water supply pipe section 27 is internally provided with a first rising convex part 31 located on the upstream of the connecting position of the suction structure and a second rising convex part 32 located on the downstream of the connecting position of the suction structure, so that the second water supply pipe section 27 forms three parts gradually rising in the direction from the liquid storage cavity 3 to the opposite-flushing mechanism 10, and the liquid suction structure is connected with the middle height part, and the additive pumped into the water supply pipeline flows into the liquid storage cavity due to the blocking of the first rising convex part under the action of gravity.

In the embodiment, the liquid pumping structure is connected with the middle part of the second water supply pipe section 27, the upstream and the downstream of the connecting position are each provided with at least one rising convex part, the first rising convex part 31 on the upstream of the connecting position enables an upstream pipeline to be lower than the connecting position, and the second rising convex part 32 on the downstream of the connecting position enables a downstream pipeline to be higher than the connecting position, and the additive pumped into the water supply pipeline 1 is blocked by the second rising convex part 32 and cannot flow out, and is guided by the first rising convex part 31 to flow to the liquid storage cavity 3 in a countercurrent mode.

In the embodiment, the second water supply pipe section 27 is provided with two straight line extending parts which extend in parallel, the ends of the same sides of the two straight line extending parts are connected through a bent part, and the ends of the other sides of the two straight line extending parts are connected with a first opening 21 of the liquid storage cavity 3 and a first water inlet branch 28 of the opposite-flushing mechanism 10 respectively. Through the arrangement of the second water supply pipe section, the second water supply pipe section has a longer derivative length on the premise that the occupied space is reduced as much as possible, and then the storage volume of the liquid storage cavity is increased.

In the embodiment, the suction structure includes a connecting pipeline 7 connected with a water supply pipeline 1 in parallel, one end of the connecting pipeline 7 is connected with a water inlet 24 of a feeding device and the water inlet end of a first water supply pipe section 26 through a tee joint 18, the other end of the connecting pipeline 7 is connected with a pump inlet 33 of a pump 6, and a pump outlet 34 of the pump 6 is connected with the middle part of a second water supply pipe section 27 of the water supply pipeline 1; and the middle part of the connecting pipeline 7 is connected with the liquid storage box 2 through a liquid pumping pipeline 8. By means of the arrangement, the opening, connected with the second water supply pipe section, of the liquid storage cavity has the dual functions of allowing the additive pumped into the water supply pipeline to flow in and allowing mixed liquid of the additive and fed water in the liquid storage cavity to flow out at the same time.

In the embodiment, a boss 30 protruding and rising towards the interior of the second water supply pipe section 27 is arranged at the connecting position of a pump outlet 34 and the second water supply pipe section 27, and the height of the water inlet end of a first water inlet branch 28 of the opposite-flushing mechanism 10 is larger than that of the boss 30. The height difference between the boss 30 and the second water supply pipe section 27 is used for forming a first rising convex part 31 on the upstream of the connecting position of the pump outlet 34 and the second water supply pipe section 27, and the height difference between the boss 30 and the water inlet end of the second water inlet branch 28 is used for forming a second rising convex part 32 on the downstream of the connecting position of the pump outlet 34 and the second water supply pipe section 27.

In the embodiment, in order to further achieve backflow of the additive pumped into the water supply pipeline 1 into the liquid storage cavity 3, the second water supply pipe section 27 can be arranged to obliquely extend from the storage cavity 3 to the gradually rising direction of the opposite-flushing mechanism 10.

The above embodiments are only the preferred embodiments of the present disclosure and do not limit the present disclosure in any form. Although the present disclosure has been disclosed as above in the preferred embodiments, the preferred embodiments are not intended to limit the present disclosure. Any technician familiar with this patent can use the technical contents suggested above to make slight changes or modifications to form the equivalent embodiments with equivalent changes without departing from the technical solution of the present disclosure. For any contents that do not depart from the technical solution of the present disclosure, any simple modifications, equivalent changes and modifications to the above embodiments according to the technical essence of the present disclosure still fall within the scope of the solutions of the present disclosure.

The invention claimed is:

1. An additive feeding device, comprising a water supply pipeline, wherein the water supply pipeline is provided with a rising convex part for increasing a height of a water path in a fed water stream direction, and the water supply pipeline on an upstream of the rising convex part is connected with a liquid storage box through a suction structure, and an additive pumped by the suction structure into the water supply pipeline flows to an upstream of the water supply pipeline in a countercurrent mode under a blocking action of the rising convex part;

a liquid storage cavity is connected to the water supply pipeline in series, the liquid storage cavity is located on the water supply pipeline on an upstream of a position where the liquid storage cavity is connected with the suction structure, and the additive flowing in the countercurrent mode enters the liquid storage cavity to be temporarily stored under an action of the rising convex part; and a liquid pumping structure is connected with a middle part of a second water supply pipe section, and each of the upstream and the downstream of a connecting position is provided with at least one rising convex part, a first rising convex part on the upstream of the connecting position causes the upstream pipeline to be lower than the connecting position, and a second rising convex part on the downstream of the connecting position causes the downstream pipeline to be higher than the connecting position.

2. The additive feeding device according to claim 1, wherein the liquid storage cavity is located on the water supply pipeline on an upstream of the second rising convex part.

3. The additive feeding device according to claim 1, wherein the water supply pipeline comprises a first water supply pipe section and a second water supply pipe section; the liquid storage cavity is connected with a water inlet of the additive feeding device through the first water supply pipe section, and the liquid storage cavity is connected with an opposite-flushing mechanism of the additive feeding device through the second water supply pipe section.

4. The additive feeding device according to claim 3, wherein the suction structure comprises a connecting pipeline connected with the water supply pipeline in parallel, and one end of the connecting pipeline is connected with the water inlet of the feeding device and a water inlet end of the first water supply pipe section through a tee joint, and the other end is connected with a pump inlet of a pump; a pump outlet of the pump is connected with the middle part of the second water supply pipe section of the water supply pipeline; a middle part of the connecting pipeline is connected with the liquid storage box through a liquid pumping pipeline; and a first one-way check valve is arranged on the connecting pipeline or the connecting position of the first water supply pipe section and the water inlet of the feeding device so as to control the liquid in the pipeline to only flow from the tee joint to the connecting pipeline or the first water supply pipe section; a second one-way check valve is arranged on the liquid pumping pipeline, or the connecting position of the liquid pumping pipeline and the connecting pipeline, or the connecting position of the liquid pumping pipeline and the liquid storage box so as to control the liquid in the pipeline to only flow from the liquid storage box to the connecting pipeline.

5. The additive feeding device according to claim 4, wherein a boss protruding and rising towards the interior of the second water supply pipe section is arranged at the connecting position of the pump outlet and the second water supply pipe section, and a water inlet end of a first water inlet branch of the opposite-flushing mechanism is higher than the boss; the height difference between the boss and the second water supply pipe section is utilized to form a first rising convex part on the upstream of the connecting position of the pump outlet and the second water supply pipe section, and the height difference between the boss and a water inlet end of a second water inlet branch forms a second rising convex part on the downstream of the connecting position of the pump outlet and the second water supply pipe section.

6. The additive feeding device according to claim 3, wherein the second water supply pipe section is arranged to obliquely extend from the storage cavity to the gradually rising direction of the opposite-flushing mechanism.

7. The additive feeding device according to claim 3, wherein the second water supply pipe section is provided with two straight line extending parts extending in parallel, ends on the same sides of the two straight line extending parts are connected through a bent part, and ends on the other sides of the two straight line extending parts are connected with a first opening of the liquid storage cavity and the first water inlet branch of the opposite-flushing mechanism respectively.

8. A washing machine, provided with the additive feeding device according to claim 1.

9. An additive feeding device, comprising a liquid storage box for containing an additive and a water path for water feeding, wherein the water path comprises a first water supply pipeline and a second water supply pipeline which are connected with an opposite-flushing mechanism and are used for respectively or simultaneously feeding water to form a plurality of fed water streams; the first water supply pipeline is connected with the liquid storage box through a suction structure, a liquid storage cavity is arranged on the first water supply pipeline, and the suction structure is used for sucking the additive in the liquid storage box into the liquid storage cavity and flushing the additive to the opposite-flushing mechanism along with water fed by the first water supply pipeline so as to feed the additive correspondingly.

10. The additive feeding device according to claim 9, wherein the water path is arranged in an upper cover of a water box, the upper cover of the water box is provided with a protruding part protruding out of the rear side of the water box, at least part of the water path is arranged on the protruding part, and the water path arranged on the protruding part at least comprises the first water supply pipeline and the second water supply pipeline.

11. The additive feeding device according to claim 10, wherein the opposite-flushing mechanism comprises a first water inlet branch and a second water inlet branch, and a first water outlet branch, a second water outlet branch and a third water outlet branch, wherein water outlet ends of the first water inlet branch and the second water inlet branch are staggered by an inclined angle and are arranged on the same side of the opposite-flushing mechanism, water inlet ends of the first water outlet branch, the second water outlet branch and the third water outlet branch are arranged on the other opposite side of the opposite-flushing mechanism; and the first water supply pipeline and the second water supply pipeline correspondingly communicate with the first water inlet branch and the second water inlet branch respectively.

12. The additive feeding device according to claim 11, wherein the opposite-flushing mechanism is arranged above the rear part of the water box, the water path below the side of the water outlet end of the water inlet branch of the opposite-flushing mechanism is provided with a notch, and the water path communicates with the interior of the water box through the notch; and the inner wall of the water path below a gap between the side of the water outlet end of the water inlet branch and the side of the water inlet end of the water outlet branch of the opposite-flushing mechanism is an inclined plane gradually descending towards the direction of the notch.

13. The additive feeding device according to claim 9, wherein an upper cover is buckled at the top of the water path, and the water path is integrated in the upper cover of the water box; the upper cover of the water box is composed of a first part and a second part which are mutually and correspondingly buckled up and down, opposite surfaces of the first part and the second part are respectively provided with grooves which are oppositely open and correspondingly overlapped, and the corresponding grooves define a water path after the first part and the second part are mutually buckled.

14. The additive feeding device according to claim 13, wherein contact surfaces of the first part and the second part are provided with concave and convex parts which are correspondingly connected in an inserted mode, and the concave and convex parts are used for positioning the first part and the second part in the buckling process.

15. The additive feeding device according to claim 9, wherein the suction structure comprises a connecting pipeline connected with the water supply pipeline in parallel, an outlet end of the connecting pipeline is connected with the water supply pipeline through a pump for providing suction power, and the liquid storage box is connected with the middle part of the connecting pipeline through a suction pipeline; an inlet end of the connecting pipeline communicates with the water supply pipeline, and a control device for controlling the flow direction and/or on-off of liquid in the pipeline is arranged on the water supply pipeline and/or the suction pipeline and used for pumping the additive into the water supply pipeline, or enabling part of the fed water stream of the water supply pipeline to flow through the connecting pipeline to wash the pump and then converge to the downstream of the water supply pipeline; and the first water supply pipeline and the second water supply pipeline are correspondingly connected with a water inlet and a second water inlet of the feeding device respectively, control valves for controlling corresponding water feeding on-off are installed at the water inlet and the second water inlet respectively, or the water inlet and the second water inlet are installed on a same reversing valve, and water is fed into the water inlet and the second water inlet respectively or simultaneously.

16. The additive feeding device according to claim 15, wherein the water supply pipeline comprises a first water supply pipe section and a second water supply pipe section; a second opening of the liquid storage cavity is connected with the water inlet of the additive feeding device through the first water supply pipe section, and a first opening of the liquid storage cavity is connected with the opposite-flushing mechanism of the additive feeding device through the second water supply pipe section.

17. The additive feeding device according to claim 16, wherein the inlet end of the connecting pipeline is connected with the water inlet of the feeding device and the first water supply pipe section through a tee joint respectively, so that the water inlet communicates with any of the connecting pipeline and the first water supply pipe section; and a first one-way check valve is arranged on the connecting pipeline, or the connecting position of the first water supply pipe section and the water inlet of the feeding device so as to control the liquid in the pipeline to only flow from the tee joint to the connecting pipeline or the first water supply pipe section; a second one-way check valve is arranged on the liquid pumping pipeline, or the connecting position of the liquid pumping pipeline and the connecting pipeline, or the connecting position of the liquid pumping pipeline and the liquid storage box so as to control the liquid in the pipeline to only flow from the liquid storage box to the connecting pipeline.

18. A washing machine, provided with the additive feeding device according to claim 9.

* * * * *